United States Patent [19]

Tran et al.

[11] Patent Number: 4,561,281

[45] Date of Patent: Dec. 31, 1985

[54] AUXILIARY GAUGING DEVICE

[75] Inventors: Ry M. Tran, Portland; Floyd E. Stevens, Beaverton; Donald L. Turk, Tigard; Kwang S. Chun, Beaverton, all of Oreg.

[73] Assignee: Tektronix, Inc., Beaverton, Oreg.

[21] Appl. No.: 572,788

[22] Filed: Jan. 23, 1984

[51] Int. Cl.[4] ..... B21D 11/22

[52] U.S. Cl. ..... 72/389; 72/461; 83/207

[58] Field of Search ..... 72/389, 461, 419, 420; 83/451, 207

[56] References Cited

U.S. PATENT DOCUMENTS

| | | | |
|---|---|---|---|
| 2,638,141 | 5/1953 | Skinner et al. | 72/31 |
| 3,225,584 | 12/1965 | Begg et al. | 72/461 |
| 3,421,359 | 1/1969 | Gibbs | 72/461 |
| 3,470,782 | 10/1969 | Acker | 83/451 |
| 3,812,695 | 5/1974 | Roch | 72/461 |
| 3,949,587 | 4/1976 | Simmons, Sr. | 72/389 |
| 4,055,070 | 10/1977 | Wingate et al. | 72/461 |

FOREIGN PATENT DOCUMENTS

| | | | |
|---|---|---|---|
| 1321682 | 6/1973 | United Kingdom | 72/461 |

*Primary Examiner*—Daniel C. Crane
*Assistant Examiner*—David B. Jones
*Attorney, Agent, or Firm*—John Smith-Hill

[57] ABSTRACT

An auxiliary gauging device for a press brake. One end of a locater bar is clamped to the back stop of the press brake. A locating pin is provided on the other end and is adapted to nest in a preformed hole of the work piece. The back stop is positioned relative to the forming tool of the press brake by calculating the distance between the locating pin and back stop, and subtracting the distance between the preformed hole and desired bend line.

4 Claims, 4 Drawing Figures

AUXILIARY GAUGING DEVICE

FIELD OF INVENTION

This invention relates to a computer controlled hydraulicly powered press brake used to form sheet metal parts and more particularly to a gauging device used to precisely locate the sheet metal parts within the press brake.

HISTORY OF INVENTION

Press brakes are commonly used for forming sheet metal parts. In general, a strip of sheet metal is cut or stamped into a specific shape, and screw locating holes are drilled or punched at specific locations relative to the shape. The press brake then bends the strip at designated locations so that the various features are accurately located in the finished product.

In many applications of such sheet metal parts, the relative location of the preformed and shaped features are critical. A bend that is off even a few thousandths of an inch will place an edge or screw hole far enough off to render the part unacceptable. The press brake is designed to accommadate this need for accuracy. The press brake includes a backstop that is precisely located by a computer controlled mechanism relative to the bending tool. The sheet metal strip is placed against the backstop and the ram of the press brake is activated to bend the strip at the exact prescribed distance from that edge.

The problem with the press brake, as described, is that some of the sheet metal parts that are desirably formed in the press brake require the bend location to be accurately located relative to a drilled or punched hole rather than the edge. That is, the specifications for such parts allow some variance of the bend from the edge location but not a screw hole location. The specifications can of course be tightened on the stamping operation to precisely form the edges relative to the holes and thereby allow the measurement of the backstop from the edge. This however severely hampers the stamping operation and is objectionable.

A second choice is to abandon use of the backstop and simply devise an alternative method of locating the part in the press brake. For example, a metal bar having a locating pin for the screw hole can be clamped to the support table of the press brake after very carefully and precisely locating the pin relative to the ram. The locating hole of the part is then positioned on the pin and the desired bend line is hopefully located under the bending tool. However, manually locating such a bar on the table reintroduces all of the objections of error and time consumption that led to the development of the computer controlled backstop in the first place.

BRIEF DESCRIPTION OF INVENTION

The present invention is believed to provide an answer to the above problem that is preferable to either of the choices briefly disclosed. In the preferred embodiment, a locater bar is adapted to be attached to the backstop. The bar is supported on the support table of the press brake but is moveable relative thereto, e.g. it is supported on a roller. A locating pin is provided on the bar which has a precise location relative to the backstop. When the computer receives the information as to the desired distance between the hole and the bend location, that distance is subtracted from the distance between the backstop and the locating pin and the difference is used to locate the backstop from the ram. The edges thus need not be precisely stamped and the bar is positioned by the backstop rather than the tedious manual procedure.

DETAILED DESCRIPTION INCLUDING DRAWINGS

A more detailed description of the invention will now be presented with reference to the accompanying drawings wherein.

Figure 1:
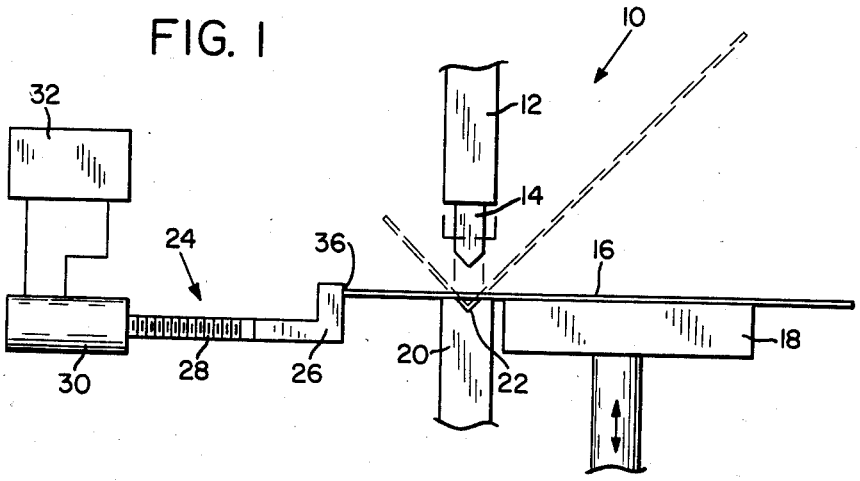
FIG. 1 is a schematic illustration of a press brake to which the present invention is applicable.

Referring to FIG. 1 of the drawings, a press brake 10 includes a hydraulic powered ram 12 that carries a bending tool 14. The tool 14 is raised and lowered by the ram 12 to impact a work piece 16 supported on a work table 18 and forming anvil 20. The forming anvil has a depression 22 mated to and aligned with tool 14. Upon impact of the work piece by the tool, the sheet metal work piece is forced into the depression to form e.g. a square corner as illustrated in dash lines.

On the side of the ram 12 opposite the work table 18 is a primary gauging mechanism 24. The gauging mechanism 24 includes a backstop 26 that is carried by positioning arms 28. The positioning arms are moved toward and away from the anvil 20 by a drive member 30 that is controlled by a computer 32.

It will be understood that the components just described in general are typical of hydraulic press brakes. Accordingly, the schematic illustration and brief explanation will be adequate for those skilled in the art and no further explanation thereof will be provided. It will also be understood that the use of the primary gauging mechanism 24 requires that the desired location of the bend must be determined by knowing the distance between the edge 36 abutting the backstop 26 and the desired bend line. With this distance known, the measurement can be given to the computer 32 which activates drive member 30 and through movement of arms 28, precisely locates the backstop 26 from the tool 14.

The operation just described is very accurate, essentially error free and fast. The problem as previously explained, is that a significant number of sheet metal parts have location tolerances for the bend line relative to the work piece edges 36 that are substantially less critical than the location tolerance of the bend line relative to, for example, screw holes found in the work piece. The cost of stamping out the part is directly related to the tightness of the tolerances. Requiring a stamping of the edges that is tighter than that required for assembly purposes, just to achieve the necessary bend line location relative to the screw hole, substantially increases the cost of the part production and is undesirable. Thus, in prior practice where this situation occurred, the gauging mechanism was abandoned for the more tedious manual setting as heretofore explained.

Figure 3:
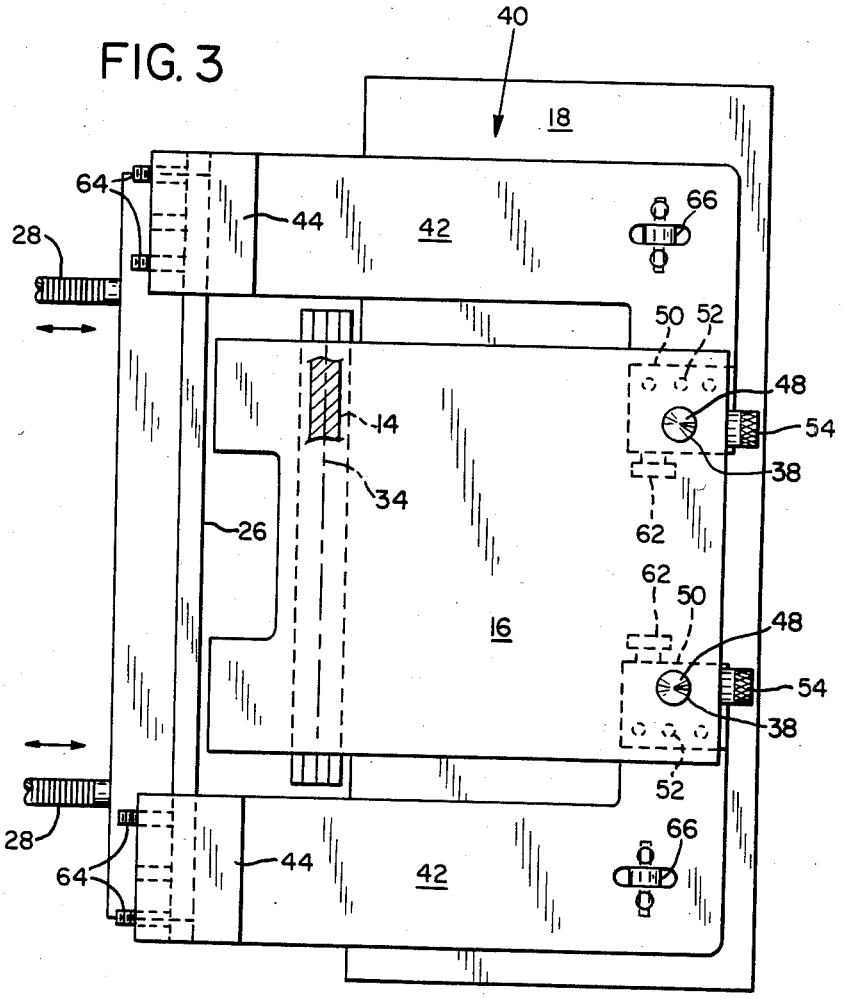
FIG. 3 is a top view of the gauging device taken on view lines 3—3 of FIG. 2, but showing the press brake components in full lines.
Figure 2:
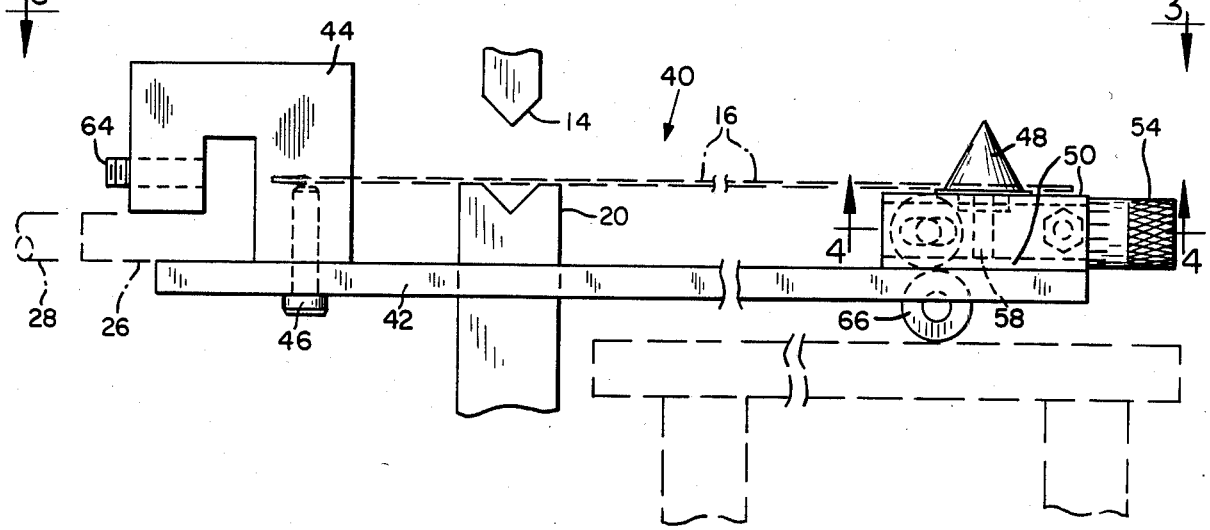
FIG. 2 is a side view of an auxiliary gauging device in accordance with the present invention with dash lines illustrating the manner in which it is mounted to the press brake.
Figure 4:
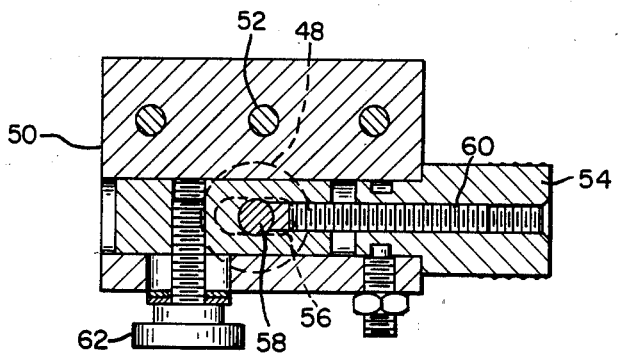
FIG. 4 is a view of the adjustment mechanism of the auxiliary gauging device taken on section lines 4—4 of FIG. 2.

The auxiliary gauging device 40 of the present invention is illustrated in FIGS. 2, 3, and 4. Hereafter it will be understood that a pair of these devices are preferably employed, one on each side of the tool 14. They are however reversible duplicates of one another and the following description will generally refer to one of these devices only while having application to both.

A locater bar 42 is provided on one end with a clamping yoke 44, the yoke being fastened to the bar by screws 46. The yoke 44, in cooperation with the end of the bar 42, forms a channel adapted to fit the cross section of backstop 26 as indicated in dash lines in FIG. 2. Located on the opposite end of the locater bar 42 is a locating pin 48 that is carried by a positioning block 50. Block 50 is secured by screws 52 to the end of the locater bar which, as will be noted, is L shaped. Block 50 is attached to the laterally extended leg of the L shape end to position the block inwardly of the bar and into alignment with tool 14. The cone shaped locating pin 48 includes a shank 58 that is seated in a slot 56 in the block 50 to permit limited movement of the pin length wise relative to the bar. Such limited movement is controlled by knob 54 which controls movement of screw shank 60 which in turn is connected to locating pin 48. A locking screw 62 locks locating pin 48 against undesired movement.

OPERATION PROCEDURE

As will be noted from FIGS. 2 and 3, the auxiliary gauging device 40 is designed so that the yoke 44 can be sliped over the backstop 26 of the gauging mechanism 24. Locking screws 64 are screwed in against the backstop to secure the auxiliary gauging mechanism 24 to the backstop 26. The opposite end of the bar is supported on the table 18 which can be raised or lowered to align the work piece with anvil. It will be understood that the back stop is moved relative to the table, and a roller 66, that is mounted in a slot in the bar, provides free sliding movement of the bar on the table 18.

It will be appreciated that tool 14 does not extend over the bar (see FIG. 3) and the inwardly extended leg of the L shaped bar end permits the placement of the locating pin 48 under the work piece 16 and into alignment with the tool 14. That is, the locating bar is configured to define a work piece support area between the back stop and locating pin that is in line with the bending tool. Thus, the work piece 16 having screw holes 38 can be precisely located by positioning the holes 38 on the locating pins, of the auxiliary gauging device. In those instances where the two holes 38 (one on each side) are not exactly aligned on the work piece, a secondary adjustment may be necessary by adjustment of knobs 54 on one or both of the auxiliary gauging devices. The adjustment knob is calibrated and with this calibration the distance between the pins 48 and the backstop is precisely fixed.

In practice, the products' designer designates the precise location of the bend line 34 relative to the screw holes 38 and that information is fed into the computer 32. The computer knows the location of the screw holes 38 relative to the backstop 26 and the location of the backstop relative to the tool 14. The computer thus adjusts the location of the backstop relative to the tool equal to the distance from the pin to the backstop less the desired distance of the pin to the bend line 34. The ram is then activated and the bend is precisely located as desired.

The essence of the present invention is the utilization of a secondary gauging mechanism or device to adapt the edge locating gauge of existing press brakes to a hole locating gauge as generally described. Those skilled in the art will conceive of variatons and modifications once having gained appreciation of the invention. These modifications and variations are encompassed within the invention as defined in the claims appended hereto.

We claim:

1. An auxiliary gauging device for a press brake designed to automatically locate a backstop relative to a bending tool for bending a work piece supported on a support table, said gauging device comprising a locater bar having a clamping yoke at one end and a locating pin disposed at the opposite end a predetermined distance from the clamping yoke, clamping means on said yoke for securing the gauging device to the backstop of the press brake to position the locating pin a known distance from the backstop, said clamping means enabling adjustment of the backstop to locate the locating pin a desired distance from the bending tool, means for movably supporting said opposite end of the bar on the support table of the press brake, said locater bar being configured to define a work piece support area between the locating pin and the backstop, and to position the pin on one side of the work piece for projection through the work piece as permitted by a locating hole in the work piece.

2. An auxiliary gauging device as defined in claim 1 wherein said support means comprises a roller mounted adjacent said other end of the bar providing said movable support.

3. In a press brake comprising a forming anvil, a support table for supporting a work piece over the anvil, a ram positioned above the anvil, and a forming tool mated to the anvil and carried by the ram to be driven by the ram toward the anvil and against the work piece, the improvement comprising a gauging device including a locater bar configured to define a work piece support area, a locating pin carried by the bar for projection through a preformed hole in a work piece positioned in said support area, support means on the locater bar movably supporting the bar on the support table, a drive member and a coupling means for coupling the bar to the drive member to position the locating pin a desired distance from the forming tool, and drive member control means for activating the drive member.

4. A press brake as defined by claim 3, wherein said locating pin is a cone-shaped member and said support means for the locater bar is a roller mounted on said bar.

* * * * *